US007338060B2

(12) United States Patent
Koch et al.

(10) Patent No.: US 7,338,060 B2
(45) Date of Patent: Mar. 4, 2008

(54) CORRIDOR CONNECTION OF A CONNECTION HAVING A BELLOWS BETWEEN TWO VEHICLES CONNECTED TOGETHER BY A JOINT

(75) Inventors: Robert Koch, Bad Sooden-Allendorf (DE); Jens Karasek, Kaufungen (DE)

(73) Assignee: Hubner GmbH, Kassel (DE)

( * ) Notice: Subject to any disclaimer, the term of this patent is extended or adjusted under 35 U.S.C. 154(b) by 320 days.

(21) Appl. No.: 11/077,317

(22) Filed: Mar. 10, 2005

(65) Prior Publication Data

US 2005/0200098 A1 Sep. 15, 2005

(30) Foreign Application Priority Data

Mar. 11, 2004 (DE) ..... 10 2004 011 865

(51) Int. Cl.
*B60D 5/00* (2006.01)

(52) U.S. Cl. ..... 280/403; 105/3

(58) Field of Classification Search ..... 280/403, 280/456.1, 458, 455.1; 105/3
See application file for complete search history.

(56) References Cited

U.S. PATENT DOCUMENTS 2,171,846 A * 9/1939 Davidson ..... 180/9.44
2,193,156 A * 3/1940 Antoine ..... 280/403
2,216,547 A * 10/1940 Christianson ..... 105/3
4,313,616 A * 2/1982 Howard ..... 280/455.1

FOREIGN PATENT DOCUMENTS

| | | |
|---|---|---|
| DE | 68 28 A | 3/1954 |
| DE | 1 248 087 B | 8/1967 |
| DE | 27 57 201 B1 | 6/1979 |
| DE | 102 09 354 A1 | 9/2003 |
| EP | 0 207 682 | 1/1987 |
| EP | 1 342 594 | 9/2003 |
| JP | 2001-2257746 A | 8/2001 |
| RU | 2 193 985 C1 | 12/2002 |

* cited by examiner

*Primary Examiner*—Lesley D. Morris
*Assistant Examiner*—Maurice Williams
(74) *Attorney, Agent, or Firm*—Thomas R. Vigil

(57) ABSTRACT

The invention is directed to a corridor connection (1) of a connection having a bellows between two vehicles connected together by a joint (30), e.g., of an articulated bus or a vehicle with a trailer, the corridor connection (1) comprising two overlapping bottom plates (2, 3) that are slidable relative to each other, said joint (30) including a joint carrier part (20) that is disposed on the one vehicle part, the lower bottom plate (2) slidably resting on said joint carrier part (20) and the upper bottom plate (3) resting on said lower bottom plate (2) in the region of said joint carrier part (20).

13 Claims, 3 Drawing Sheets

CORRIDOR CONNECTION OF A CONNECTION HAVING A BELLOWS BETWEEN TWO VEHICLES CONNECTED TOGETHER BY A JOINT

CROSS-REFERENCE TO RELATED APPLICATIONS

This application claims Priority from German Application No. DE 10 2004 011 865.5 filed on 11, Mar. 2004.

BACKGROUND OF THE INVENTION

1. Field of the Invention

The present invention relates to a corridor connection of a connection having a bellows between two vehicles connected together by a joint, e.g., of an articulated bus or a vehicle with a trailer.

2. Description of the Prior Art

Corridor connections of the most different types are well known as part of a connection between vehicles connected together by a joint, of an articulated bus for example. All of these known corridor connections however are supported by the joint. It is possible to have the corridor connection supported by the joint because the pivot point at the joint is stationary. In this respect, the corridor connection only needs to be a plate supported by the hinge. Two portions of the corridor project as far as said plate and are connected by a hinge to the bottom of the vehicle in order for the joint to be accessible so that the corridor parts may be appropriately folded upward.

Another joint is known, the rotation center of which is not stationary though. Such a joint is known from DE 102 09 354 A1 and is referred to herein as "universal joint". The peculiarity of said joint is that it is built in a relatively short construction schedule and that the pivot point of the joint moves outward in accordance with the radius of the curve the vehicle has to thread. This means that the pivot point is not stationary. In this respect, a corridor construction as it is known from prior art is out of the question.

BRIEF SUMMARY OF THE INVENTION

It is therefore the object of the invention to provide a corridor connection that is not supported by the joint and that, in this respect, may also be utilized with connections having joints the pivot point of which is not stationary.

This object is solved, in accordance with the invention, in that the corridor connection comprises two overlapping bottom plates that are slidable relative to each other, the joint including a joint carrier part that is disposed on the one vehicle part, the lower bottom plate slidably resting on the joint carrier part and the upper bottom plate being supported by the lower bottom plate in the region of the joint carrier part.

It is obvious therefrom that the corridor connection is no longer supported by the movable parts of the joint but by the stationary parts of said joint. Meaning, there exists an unsupported portion of the corridor connection so that sagging may occur. This free portion of the corridor connection is short though, since the universal joint, as already explained herein above, is also built in a short construction schedule.

Further advantageous features and implementations will become apparent from the dependent claims.

For example, in accordance with a particular feature of the invention, it is provided that the upper bottom plate is flexible and abrasion resistant. As already explained herein above, the upper bottom plate slides on the lower bottom plate. In this respect, a certain abrasion resistance and slidability between the two bottom plates is advantageous; said advantage may be achieved by having the upper bottom plate made of a plastic material for example. The lower bottom plate should also be elastic as it is also subjected to deformation, for example during nodding movements. In this respect, the lower bottom plate can be manufactured in the same manner as the upper bottom plate.

In order to provide such a plastic bottom plate with the required stability, reinforcing elements are incorporated in the plastic material of the bottom plate in accordance with another feature of the invention. This means that a bottom plate manufactured by injection moulding is injection moulded around the corresponding inserted reinforcing elements.

Since the lower bottom plate also executes a movement relative to the joint carrier part on which it is resting when the vehicle is threading a curve, it is necessary to permit sliding movement between the surface of the joint carrier part on the one side and the underside of the lower bottom plate on the other side. In this respect, sliding elements for sliding movement of the lower bottom plate are provided on the joint carrier part. A reversed arrangement of the sliding elements on the lower bottom plate may also be envisaged. Such sliding elements may be particularly abrasion resistant plastic parts and may furthermore have a low coefficient of friction.

Advantageously, the joint carrier part has a tie bar that is disposed on the joint carrier part in the region where the lower bottom plate merges into the upper bottom plate. Said tie bar serves as an additional support and bearing surface for the lower bottom plate and therefore comprises corresponding sliding elements for the sliding movements of the lower bottom plate in this region as well.

As already explained herein above, the corridor connection described herein above is particularly suited, in accordance with the invention, for what is termed a universal joint. Such a universal joint comprises two crosswise-disposed joint arms with the joint arms being rotatably fastened at their one end to the joint carrier part and at their other end to joint brackets, with said joint brackets being disposed on the other vehicle part. It should be reminded here that the present invention finds application both in articulated vehicles and in pullers having an uncouplable trailer. Such a universal joint is further characterized in that, in the region where they are linked to the joint carrier part, the joint arms comprise at their end a cam for receiving a damper, said damper being for example configured to be a hydraulic piston and cylinder unit that communicates with the joint carrier part. It is obvious therefrom that the deflection of the joint arms is dampened when the vehicle is threading a curve.

In order to make certain that the lower plate will not protrude laterally from the upper bottom plate when the vehicle is threading a curve, the lower bottom plate comprises a gable-like, that is slightly conically tapering end region in the region of the upper bottom plate.

As already explained herein above, and more particularly when the corridor connection is used for the connection of a vehicle consisting of a puller and a trailer, the puller should be usable separately from the trailer. This also means that the corridor connection must also be readily dividable. In this respect, it is provided that the lower bottom plate, which is fastened to the other vehicle part, comprises a hinge in the region of the joint brackets in order for the bottom plate to be foldable upward when the rear vehicle part is being uncoupled from the front vehicle part.

It is further provided that the front edge of the upper bottom plate is configured to be rounded inward in the region where it merges into the lower bottom plate. Such an inward rounded upper bottom plate permits to save material, which translates into a saving of costs and furthermore causes the two bottom plates to overlap in the region of the joint carrier part. The important point however is the following aspect: in configuring the upper bottom plate to be rounded inward, the relative velocity of the two moving bottom plates is reduced as compared to the case in which the upper bottom plate were to overlap the lower bottom plate over a large surface. This finally serves the comfort needs of the passengers and their security needs as well. Furthermore, a sealing lip for preventing dirt from penetrating into the joint from the top is provided in the region of the front edges of the upper bottom plate.

The invention will be understood better upon reading the exemplary description accompanying the drawing.

DETAILED DESCRIPTION OF THE INVENTION

Figure 1:
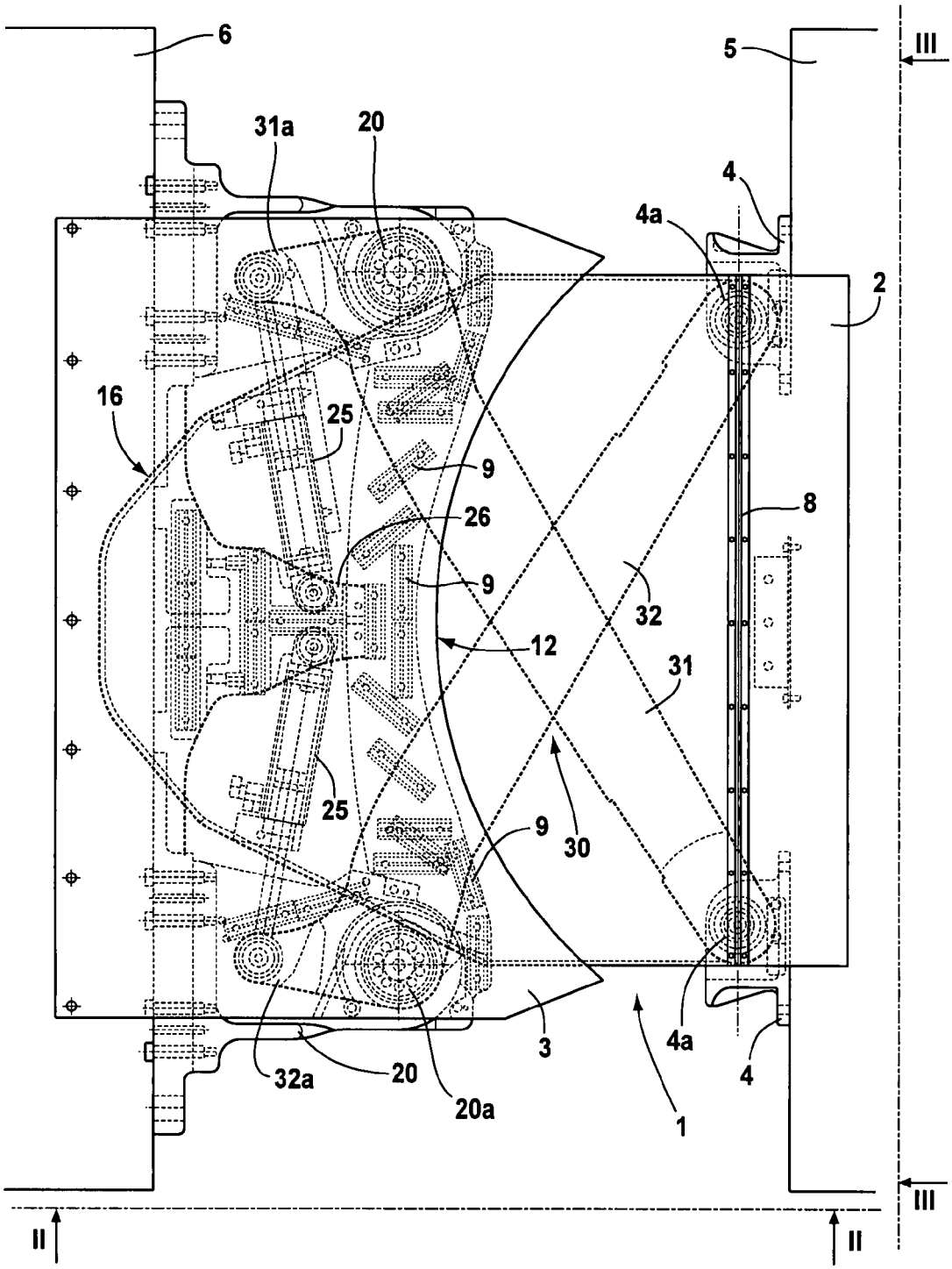
FIG. 1 is a top view of the corridor connection with the universal joint being visible.
Figure 2:
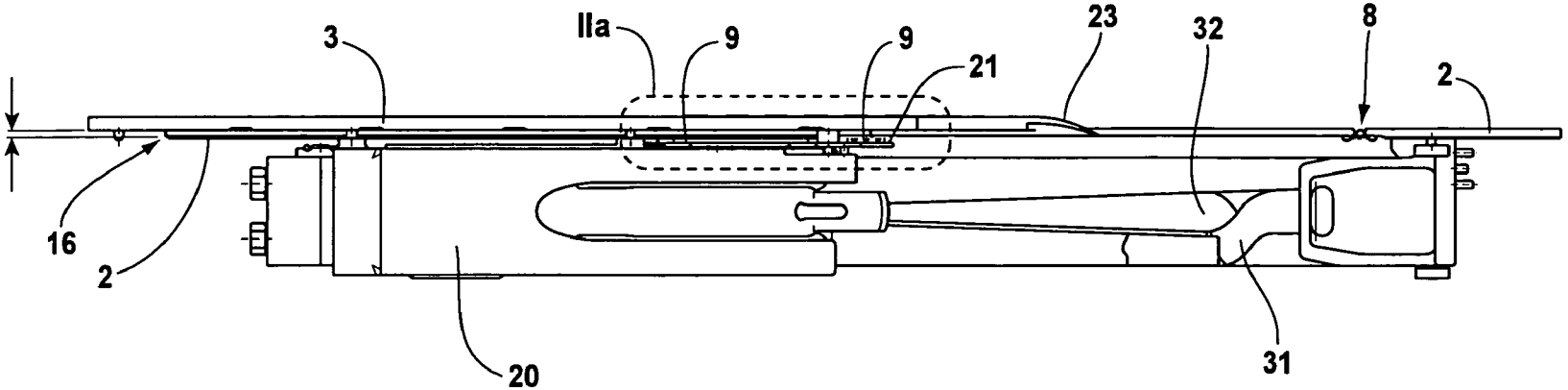
FIG. 2 is a side view taken along line II-II of FIG. 1.
Figure 2A:
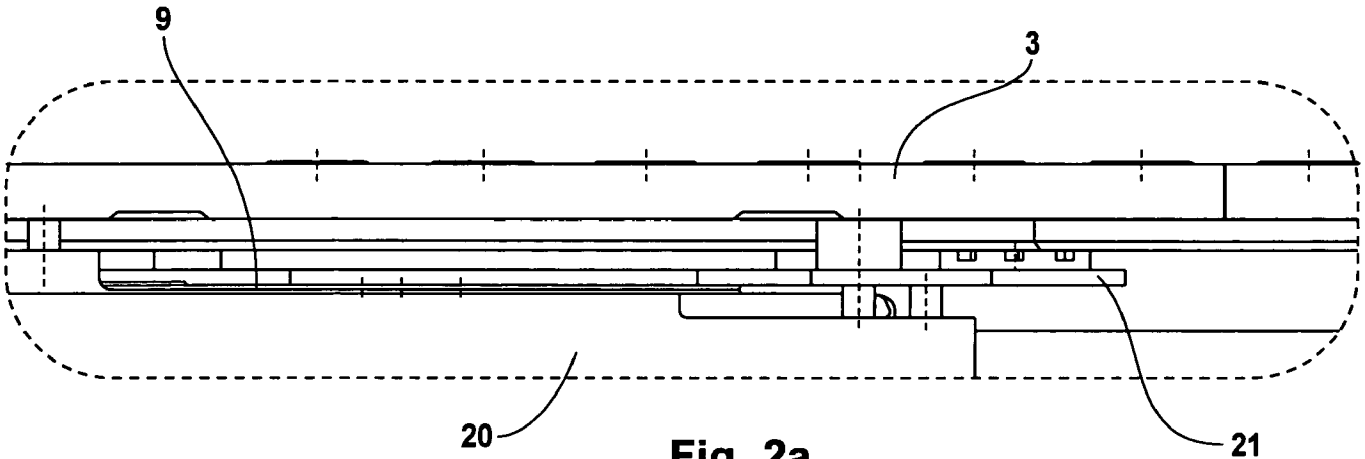
FIG. 2*a* is an enlarged detail of FIG. 2.
Figure 3:
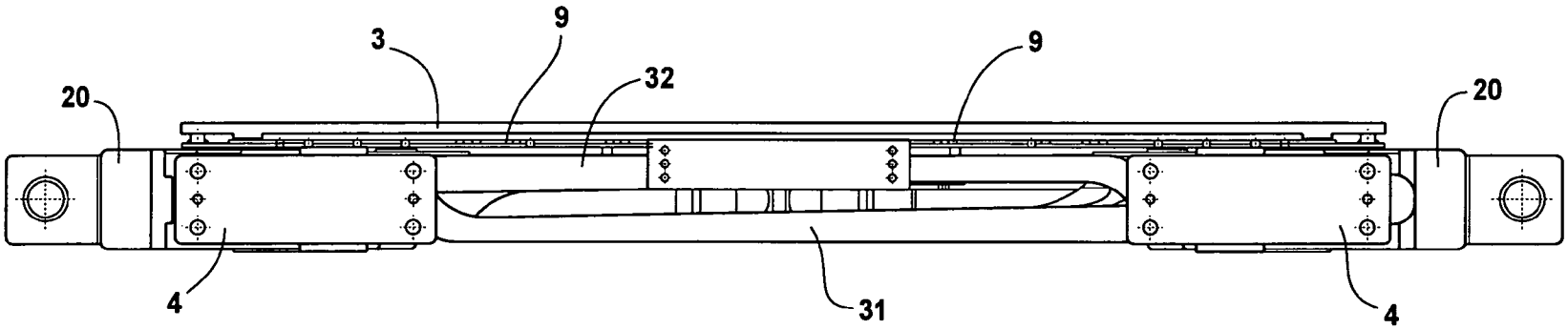
FIG. 3 is a view taken along line III-III of FIG. 1.

The corridor connection, which is indicated generally at 1, comprises the lower bottom plate 2 and the upper bottom plate 3. The lower bottom plate 2 is carried on the two joint brackets 4 that are fastened to the chassis of the front car 5. The upper bottom plate 3 is carried on the joint carrier part indicated at 20 and is rigidly connected with screws both to the latter and to the chassis 6 of the rear car. A vertical spacing X (FIG. 2), which is configured in the fashion of a pocket and serves to movably receive the lower bottom plate 2, is located between the upper bottom plate 3 and the joint carrier part 20. The joint carrier part 20 moreover has a tie bar 21 that extends parallel to the transverse axis of the joint or parallel to the transverse axis of the vehicle in general, with the lower bottom plate slidably resting on the tie bar 21. For this purpose, the tie bar 21 has sliding elements 9 on which the lower bottom plate slides. The joint carrier part 20 has further sliding elements 9 between the lower bottom plate 2 and the joint carrier part 20 for the lower bottom plate 2. The sliding elements may however also be disposed in reverse, i.e., on the bottom plate.

The joint itself is configured as follows: The joint, which is indicated generally at 30, has the two crossing joint arms 31 and 32. At their one end, the two joint arms are respectively rotatably and non-rotatably carried on the joint bracket 4 with the assistance of a bearing 4*a*. At their other end, the joint arms 31 and 32 are received by the joint carrier part 20. The joint carrier part 20 also possesses a bearing 20*a* for rotatably receiving the two joint arms. At their end, the joint arms are each provided with a cam 31*a* and 32*a* respectively, a piston and cylinder unit 25 that is connected to the bearing pillow 26 of the joint carrier part 20 being disposed at a respective one of the cams. The linkage of the piston and cylinder unit 25 or of the damper 25 respectively, both to the respective one of the cams 31*a* and 32*a* and to the bearing pillow 26, is pivotal.

In the region of the center of the bearing 4*a* of the joint bracket 4, the lower bottom plate 2 moreover has a hinge 8 for pivoting the lower bottom plate upward. In the region where the upper bottom plate 3 merges into the lower bottom plate 2, it has an inward rounded recess 12 on its front side, said recess 12 approximately conforming to the orientation of the tie bar 21. The sealing lip, which forms the front side end, is labelled at 23. Said sealing lip prevents dirt from penetrating into the joint.

In the region of the joint carrier part 20, the lower bottom plate 2 furthermore has a gable-like orientation that is indicated by the arrow 16 so that the lower bottom plate is prevented from protruding laterally from the upper bottom plate 3 when the vehicle is threading a curve.

The bellows surrounding the connection and the joint has been removed in the drawing.

The invention claimed is:

1. A corridor connection (1) of a connection having bellows between two vehicles connected together by a joint (30), of an articulated bus or a vehicle with a trailer, said corridor connection (1) having two overlapping bottom plates (2, 3) that are slidable relative to each other, characterized in that said joint (30) includes a joint carrier part (20) that is disposed on one vehicle part, the lower bottom plate (2) slidably resting on said joint carrier part (20) and the upper bottom plate (3) resting on said lower bottom plate (2) in the region of said joint carrier part (20).

2. The corridor connection as set forth in claim 1, characterized in that at least one of the upper or the lower bottom plate (2, 3) configured to be flexible and abrasion resistant.

3. The corridor connection as set forth in claim 1, characterized in that at least one of the upper or the lower bottom plate (2, 3) are made from a plastic material.

4. The corridor connection as set forth in claim 3, characterized in that reinforcing elements are incorporated into the plastic material of the respective one of the bottom plates (2, 3).

5. The corridor connection as set forth in claim 1, characterized in that sliding elements (9) for the lower bottom plate (2) are disposed on the joint carrier part (20).

6. The corridor connection as set forth in claim 1, characterized in that joint carrier part (20) has a tie bar (21) that is disposed on the joint carrier part (20) in the region where the lower bottom plate (2) merges into the upper bottom plate (3).

7. The corridor connection as set forth in claim 1, characterized in that joint (30) has two crosswise-disposed arms (31) with the arms being rotatably fastened at their one end to the joint carrier part (20) and at their other end to joint brackets (4), with said joint brackets (4) being disposed on the other vehicle part.

8. The corridor connection as set forth in claim 7, characterized in that, in the region where they are linked to the joint carrier part (20), the joint arms (31) have at their end a cam (31*a*) for receiving a damper (25), said damper (25) communicating with the joint carrier part (20).

9. The corridor connection as set forth in claim 1, characterized in that the lower bottom plate (2) has a gable-like end region in the region of the upper bottom plate (3).

10. The corridor connection as set forth in claim 8, characterized in that, in the region of the joint brackets (4), the lower bottom plate (2) has a hinge (8) for folding the lower bottom plate (2) upward.

11. The corridor connection as set forth in claim 1, characterized in that, in the region where the upper bottom plate (3) merges into the lower bottom plate (3), the front edge of the upper bottom plate is rounded inward.

12. The corridor connection as set forth in claim 1, characterized in that the front side of the upper bottom plate (3) has a sealing lip (23) that extends over the length of the front side.

13. A corridor connection of a connection having a bellows between two vehicles connected together by a joint (30) of an articulated bus or a vehicle with a trailer, said corridor connection having two overlapping bottom plates that are slidable relative to each other, characterized in that said joint (30) includes a joint carrier part that is disposed on one vehicle part, the lower bottom plate slidably resting on said joint carrier part (20) and the upper bottom plate (3) resting on said lower bottom plate (2) in the region of said joint carrier part (20) and that sliding elements (9) for the lower bottom plate (2) are disposed on the joint carrier part (20).

* * * * *